United States Patent [19]

Kolodziej

[11] 4,044,636

[45] Aug. 30, 1977

[54] METHOD AND APPARATUS FOR FORMING A HELICAL CUTTER STRIP FOR A DRY SHAVER ASSEMBLY

[75] Inventor: Alojzy Antoni Kolodziej, Stobhill, Northcumberland, England

[73] Assignee: Ronson Corporation, Woodbridge, N.J.

[21] Appl. No.: 635,093

[22] Filed: Nov. 25, 1975

Related U.S. Application Data

[63] Continuation-in-part of Ser. No. 455,535, March 28, 1974, Pat. No. 3,927,581.

[30] Foreign Application Priority Data

Apr. 2, 1973 United Kingdom ..... 15759/73

[51] Int. Cl.[2] ..... B21K 11/00; B21D 11/08

[52] U.S. Cl. ..... 76/104 R; 72/167

[58] Field of Search ..... 72/136, 137, 167, 168; 76/104 R, DIG. 8

[56] References Cited

U.S. PATENT DOCUMENTS

| | | | |
|---|---|---|---|
| 3,927,581 | 12/1975 | Kolodziej | 76/104 R |

FOREIGN PATENT DOCUMENTS

| | | | |
|---|---|---|---|
| 18,241 | 6/1962 | Japan | 72/167 |
| 11,899 of | 9/1887 | United Kingdom | 72/168 |
| 1,263,643 | 2/1972 | United Kingdom | 72/168 |

*Primary Examiner*—Al Lawrence Smith
*Assistant Examiner*—James G. Smith
*Attorney, Agent, or Firm*—Toren, McGeady and Stanger

[57] ABSTRACT

The cutter strip of a dry shaver assembly is formed into a helical configuration by edgewise passage thereof between three rollers which are mounted for rotation about parallel axes and which comprise a main roller and a pair of auxiliary rollers, with the auxiliary rollers having a smaller diameter than the main roller. The cutter strip which is passed between the circumferences of the rollers is formed with undulations extending lengthwise of the strip and the two auxiliary rollers have circumferential slots formed with a width sufficiently large to accommodate the undulations of the strip. The circumferential slots in the auxiliary rollers are offset axially of the rollers to a degree commensurate with the helical pattern which is to be formed.

5 Claims, 7 Drawing Figures

METHOD AND APPARATUS FOR FORMING A HELICAL CUTTER STRIP FOR A DRY SHAVER ASSEMBLY

This application is a continuation-in-part of my prior application Ser. No. 455,535 filed Mar. 28, 1974, now U.S. Pat. No. 3,927,581.

BACKGROUND OF THE INVENTION

The present invention relates generally to cutting units for dry shavers and more particularly to a dry shaver of the type wherein the cutting unit reciprocally located within a perforated foil of the shaver. More specifically, the invention relates to a method and apparatus for forming the cutter strip of the cutting unit into a helical configuration. The cutting strip is of the type which is formed with undulations extending along the lengths of the strip and after formation into its helical pattern the strip is mounted upon a central longitudinal support member.

In the type of dry shaver to which the present invention relates, the perforated foil of the shaver is placed in contact with the skin and hair protruding through the perforations of the foil is cut by a shearing action which occurs between the cutting edge of the reciprocating cutter unit and the edges of the perforations.

An important consideration in such shavers requires that the cutter unit be arranged to operate in an efficient manner. It has been found that a cutter unit formed from a plurality of parallel blades mounted in a rigid support will operate efficiently. However, although such a cutter unit exhibits adequate efficiency, it involves an arrangement which has been found difficult and costly to manufacture.

In one method of construction offering some manufacturing advantages, a wire is wound on a mandrel having a circular cross section with subsequent grinding operation being performed to provide a cutting edge for the cutter unit. Cutters made in accordance with this prior art method have not, however, been found satisfactory primarily due to the fact that it is difficult to grind or otherwise provide a cutting edge in the unit. Furthermore, it has been found that the blades themselves develop inherent weaknesses.

Accordingly, there has been proposed a cutter unit for a dry shaver which involves utilization of an elongated strip which is wound edgewise into a helical configuration. The strip has undulations extending along the length thereof and the helically wound strip is mounted or embedded in a central longitudinal support member in order to form the cutter unit for the shaver.

The present invention relates to an improved method and apparatus for forming the undulated cutter strip of such a unit into a helix. The invention is directed to the provision of a cutter unit of this type which will exhibit superior operating characterists but which will not create adverse manufacturing problems.

SUMMARY OF THE INVENTION

Briefly, the apparatus of the present invention may be described as comprising a triad of rollers which includes a main roller or mandrel and a pair of auxiliary rollers arranged to engage the periphery of the main roller or mandrel in such a manner that when an elongated undulated cutter strip is passed between the circumferences of the rollers, a helical form is imparted to the strip. The cutter strip comprises a generally elongated configuration and before the strip is passed through the roller triad undulations are formed in the strip which extend along the length thereof. The main roller or mandrel of the apparatus is formed with a diameter which is larger than the diameter of the auxiliary rollers. Each of the rollers of the roller triad are arranged for rotation about parallel axes. Both of the auxiliary rollers are shaped with circumferential slots thereabout with the slots having a width dimension which is sufficiently large to accommodate therein the undulations of the cutter strip. The slots are offset relative to each other axially of the rollers and in the performance of the method of the invention the strip is passed in an edgewise position through the slots of the auxiliary rollers in order to thereby press an edge of the strip against the circumference of the main roller or mandrel. As a result of the axial spacing of the slots and of the overall arrangement of the roller triad, the strip will have a helical formation imparted thereto by passage through the apparatus of the invention.

The various features of novelty which characterize the invention are pointed out with particularity in the claims annexed to and forming a pair of this disclosure. For a better understanding of the invention, its operating advantages and specific objects attained by its use, references should be had to the accompanying drawings and descriptive matters in which there is illustrated and described a preferred embodiment of the invention.

DETAILED DESCRIPTION OF THE PREFERRED EMBODIMENT

Figure 1:
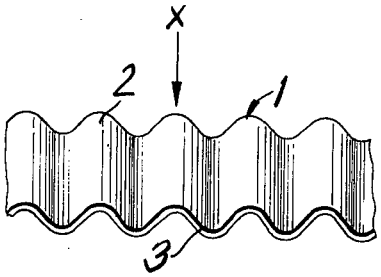
FIG. 1 is a perspective view depicting a portion of a cutter strip of the type utilized in connection with the present invention.
Figure 2:
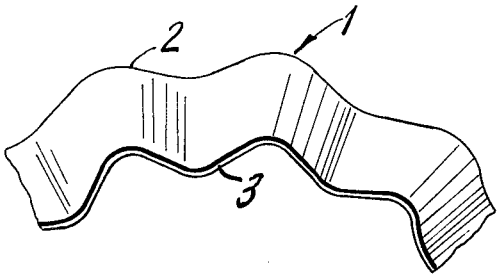
FIG. 2 is a perspective view showing the shape of a portion of the cutter strip after it has been wound in a helical configuration by the apparatus of the present invention.
Figure 3:
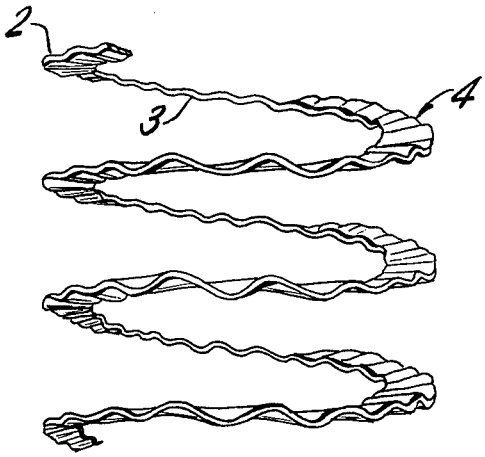
FIG. 3 is a perspective view of the overall cutter strip wound in the form of a helix by the method and apparatus of the invention.
Figure 4:
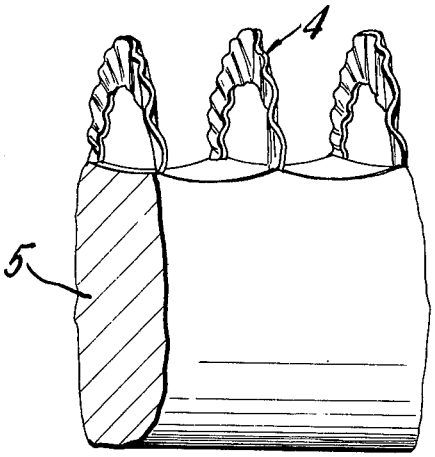
FIG. 4 is a perspective view showing a portion of a cutter unit which utilizes the cutter strip wound in helical form by the present invention.
Figure 5:
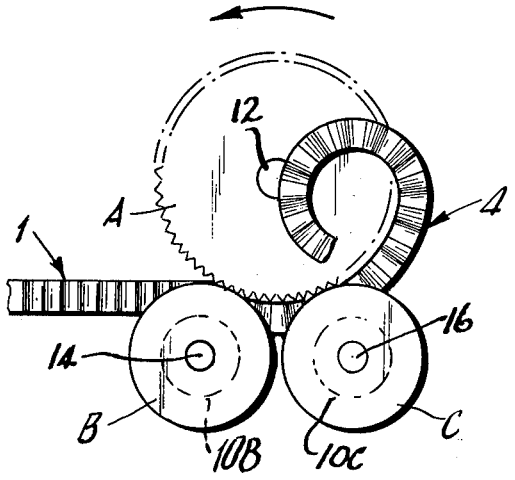
FIG. 5 is an end view of the apparatus of the present invention showing the cutter strip as it is passed therethrough.
Figure 6:
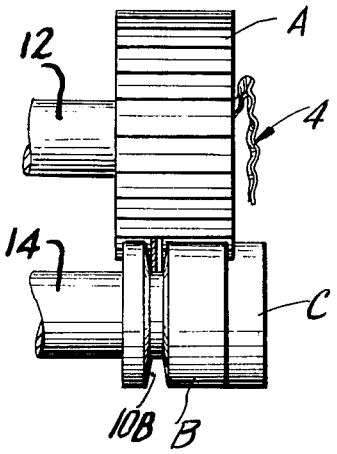
FIG. 6 is a side view of the apparatus of FIG. 5.
Figure 7:
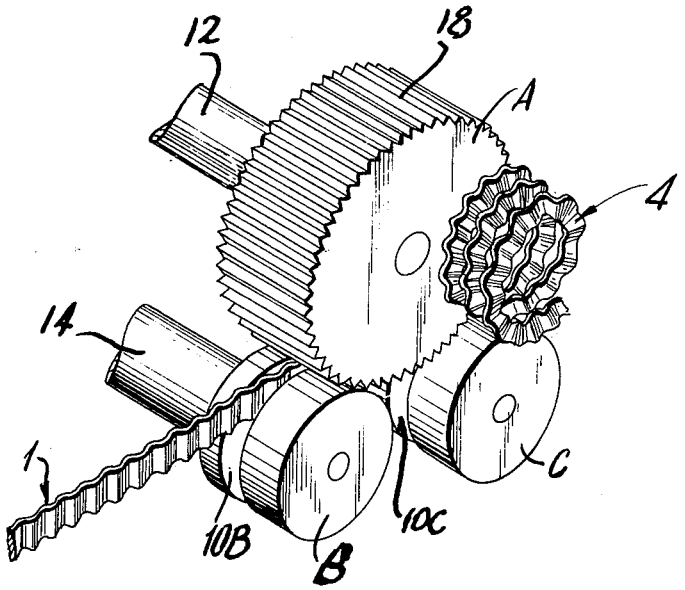
FIG. 7 is a perspective view of the apparatus of the invention showing the cutter strip during its formation.

Referring now to the drawings, wherein like reference numerals refer to similar parts throughout the various figures thereof, there is shown in FIG. 1 a portion of a strip 1 of cutter material which is to be formed by the method and apparatus of the present invention. The strip 1 may be made of any suitable cutter material and it is formed with undulations or waves which extend longitudinally of the strip throughout its length. The strip 1 comprises a pair of longitudinal edges 2 and 3 and, in FIG. 1, the strip is shown before it is wound in a helical configuration in the practice of the present invention. In the formation of the cutter unit with which the strip is utilized, the strip 1 must first be wound edgewise into a helical configuration identified by the numeral 4 and shown in FIG. 3. With the strip wound in the form shown generally in FIG. 3, the strip may then be mounted or embedded in a longitudinal support member 5 in order to form the overall cutter unit. The cutter unit, including the helically wound strip 4 and the longitudinal support member 5 is depicted in FIG. 4. FIGS. 5, 6 and 7 depict the apparatus of the present invention utilized for winding strip 4 into its helical shape. As depicted in FIGS. 5–7, the apparatus of the invention involves a triad of rollers which comprises the rollers A, B and C.

The roller A is a main roller or mandrel having a diameter which is larger than the diameter of either of the rollers B or C. The rollers B and C may be considered auxiliary rollers and, as seen in the drawings, they are arranged with their circumferences generally coincident with or adjacent to the circumference of the main roller or mandrel A.

The rollers A, B and C are mounted for rotation upon shafts 12, 14 and 16, respectively, with the axis of rotation of each of the rollers being parallel to the axis of rotation of each of the other rollers.

The rollers B and C are each formed with a circumferential slot 10B and 10C, respectively, which extend about the periphery of each of the auxiliary rollers. The main roller or mandrel A is formed on its circumference with serrations or corrugations 18 extending generally axially along the roller circumference.

In the performance of the method of the present invention, the strip 1 having undulations formed therein is first introduced into the roller triad A-B-C by insertion of the strip 1 in an edgewise position into the slot 10B. Rotation of the rollers will cause the strip 1 to be drawn about the circumference of the mandrel A through the slot 10B and into the slot 10C of the second auxiliary roller C.

As the rollers A, B and C are rotated, the strip 1 will pass through the slots 10B, 10C and be pressed about the circumference of the roller A against the serrations 18. As a result, the strip will pass out of the slot 10C and because of its engagement within the roller triad A-B-C, the strip will be formed into the helical shape 4 shown in the drawings and best seen in FIG. 7.

The slots 10B and 10C are formed with a width dimension which is sufficiently large to accommodate therein the undulations of the strip 1. That is, the widths of the slots 10B, 10C must be at least as large as the amplitude of the wave pattern of the undulations which extend lengthwise of the strip 1.

Furthermore, the depth of the slots 10B, 10C must be formed with an appropriate dimension in order to enable the edge of the strip 1 to be pressed against the circumferential surface of the roller A to a degree appropriate for forming the helical configuration 4 of the strip.

As shown in the drawings and as best seen in FIGS. 6 and 7, the slots 10B and 10C are offset laterally in a direction axially of the rollers. That is, as seen in FIG. 6, the roller C may be placed at a position somewhat to the right of the roller B so that the slot 10C will be to the right of the slot 10B when the apparatus is viewed from the direction indicated in FIG. 6.

As a result of the offset arrangement of the slots 10B, 10C, when the strip 1 is introduced into the slot 10B it will pass in a rightward direction, as viewed in FIG. 6, into the slot 10C and, as a result, it will exit from the point of contact between the roller A and the roller C in its helical pattern.

The degree to which the slots 10B and 10C are offset will determine the final pitch of the helix 4 which is formed.

Of course, other considerations are involved in the formation of the helix regarding the size and diameter of the helix which is formed. A primary consideration is the fact that the roller A is of larger diameter than the rollers B and C. Furthermore, the points of contact between the roller A and each of the rollers B and C respectively has an effect upon the shape of the helix which is formed. For example, the various diameters of the rollers could be varied within limits and the general positioning of the rollers B and C relative to each other and relative to the roller A could also be varied within limits, as will be apparent to those skilled in the art, in order to adjust the parameters of the helical configuration to be formed.

As a result of the overall arrangement of the invention, the diameter of the helix which is formed is not dependent upon the geometry of the roller arrangement and is not dependent upon the diameter of any one of the rollers. Thus, it will be seen that variations of the overall arrangement depicted and described herein may be effected by those having ordinary skill in the art to vary the specific dimensions of the arrangement and of the helix which is formed without departing from the spirit and scope of the invention.

While a specific embodiment of the invention has been shown and described in detail to illustrate the application of the inventive principles, it will be understood that the invention may be embodied otherwise without departing from such principles.

What is claimed is:

1. Apparatus for winding into a helical configuration the elongated cutter strip of a dry shaver cutter unit having an undulated configuration extending throughout the length thereof, said apparatus comprising a main roller, a pair of auxiliary rollers each having a diameter smaller than the diameter of said main roller, each of said rollers being mounted for rotation about parallel axes, means defining in each of said auxiliary rollers a circumferential slot having a width sufficient to accommodate therein the undulations in said strip to permit edgewise passage of said strip therethrough, said slots being displaced from each other in a direction axially of said main roller, said rollers being arranged to effect pressing of an edge of said strip against the circumference of said main roller by passage of said strip edgewise through said slots with rotation of said rollers operating to effect the winding of said strip in a helical formation.

2. Apparatus according to claim 1 wherein said main roller comprises serrations on its circumferential surface.

3. Apparatus according to claim 1 wherein said slots comprise a depth dimension less than the width dimension of said strip.

4. A method for winding into a helical configuration an elongated cutter strip for the cutter unit of a dry shaver assembly having undulations extending along the length thereof comprising the steps of passing said elongated cutter strip in an edgewise position through a roller triad including a main roller and a pair of auxiliary rollers mounted for rotation about parallel axes, said auxiliary rollers each having a diameter smaller than the diameter of the main roller and arranged relative to said main roller to circumferentially receive said strip between said main roller and each of said auxiliary rollers, with passage of said undulated strip in said edgewise position circumferentially about said main roller between said main roller and each of said auxiliary rollers operating to form said strip in said helical configuration, said elongated cutter strip being first passed between said main roller and one of said auxiliary rollers through a circumferential slot formed in said one auxiliary roller and being subsequently passed between said main roller and the other of said auxiliary rollers through a circumferential slot formed in said other roller offset axially of said roller triad relative to said slot in said one auxiliary roller.

5. A method for winding into a helical configuration an elongated cutter strip for the cutter unit of a dry shaver assembly having undulations extending along the length thereof comprising the steps of passing said elongated cutter strip in an edgewise position through a roller triad including a main roller and a pair of auxiliary rollers mounted for rotation about parallel axes, said auxiliary rollers each having a diameter smaller than the diameter of the main roller and arranged relative to said main roller to circumferentially receive said strip between said main roller and each of said auxiliary rollers, with passage of said undulated strip in said edgewise position circumferentially about said main roller between said main roller and each of said auxiliary rollers operating to form said strip in said helical configuration, said elongated cutter strip being first passed between said main roller and one of said auxiliary rollers and being subsequently passed between said main roller and the other of said auxiliary rollers with said main roller and said auxiliary rollers being configured such that they impart to said strip as it is passed therebetween a directional component of travel extending obliquely to said parallel axes.

* * * * *